US011148423B2

(12) United States Patent
Clippingdale et al.

(10) Patent No.: US 11,148,423 B2
(45) Date of Patent: Oct. 19, 2021

(54) METHOD OF OPERATING AN INKJET PRINTHEAD

(71) Applicant: TONEJET LIMITED, Royston (GB)

(72) Inventors: Andrew John Clippingdale, Cambridge (GB); Robert James Greasty, Cambridge (GB); Jonathan James Michael Halls, Cambridge (GB)

(73) Assignee: Tonejet Limited, Royston (GB)

( * ) Notice: Subject to any disclaimer, the term of this patent is extended or adjusted under 35 U.S.C. 154(b) by 0 days.

(21) Appl. No.: 15/756,669

(22) PCT Filed: Sep. 2, 2016

(86) PCT No.: PCT/EP2016/070698
§ 371 (c)(1),
(2) Date: Mar. 1, 2018

(87) PCT Pub. No.: WO2017/037224
PCT Pub. Date: Mar. 9, 2017

(65) Prior Publication Data

US 2018/0281419 A1 Oct. 4, 2018

(30) Foreign Application Priority Data

Sep. 2, 2015 (EP) ..... 15183573

(51) Int. Cl.
*B41J 2/14* (2006.01)
*B41J 2/39* (2006.01)
*B41J 2/165* (2006.01)

(52) U.S. Cl.
CPC ..... *B41J 2/16552* (2013.01); *B41J 2/14314* (2013.01); *B41J 2/1652* (2013.01);
(Continued)

(58) Field of Classification Search
None
See application file for complete search history.

(56) References Cited

U.S. PATENT DOCUMENTS 5,929,877 A * 7/1999 Hetzer ..... B41J 2/16552 347/22
6,196,657 B1 * 3/2001 Hawkins ..... B41J 2/16552 347/25

(Continued)

FOREIGN PATENT DOCUMENTS

CN 1694812 11/2005
EP 0340960 11/1989

(Continued)

OTHER PUBLICATIONS

International Search Report & Written Opinion in Application No. PCT/EP2016/070698 dated Feb. 7, 2017, 13 pages.

(Continued)

*Primary Examiner* — Alejandro Valencia
(74) *Attorney, Agent, or Firm* — Kowert, Hood, Munyon, Rankin & Goetzel, P.C.

(57) ABSTRACT

A method of operating an electrostatic ink jet printhead, the printhead comprising: one or more ejection tips from which, in use, ink is ejected, the one or more ejection tips defining a tip region; a printhead housing, the printhead housing defining a cavity in which the one or more ejection tips are located; the method comprising the steps of, during a printing operation, passing a vapour into the cavity to reduce evaporation of ink in the tip region.

21 Claims, 14 Drawing Sheets

(52) U.S. Cl.
CPC ..... *B41J 2/16517* (2013.01); *B41J 2/39* (2013.01); *B41J 2202/07* (2013.01); *B41J 2202/19* (2013.01)

(56) References Cited

U.S. PATENT DOCUMENTS

| | | | | |
|---|---|---|---|---|
| 6,286,938 | B1 * | 9/2001 | Okano | B41J 2/06 347/40 |
| 6,575,556 | B1 * | 6/2003 | Eremity | B41J 2/16552 347/28 |
| 7,604,332 | B2 * | 10/2009 | Nagashima | B41J 2/175 347/22 |
| 2006/0170753 | A1 | 8/2006 | Higuchi | |
| 2011/0242204 | A1 * | 10/2011 | Shinoda | B41J 2/16505 347/29 |
| 2015/0151554 | A1 | 6/2015 | Kato et al. | |
| 2015/0303151 | A1 | 10/2015 | Kobayashi | |
| 2016/0221343 | A1 * | 8/2016 | Brewster | B41J 2/16505 |

FOREIGN PATENT DOCUMENTS

| | | | |
|---|---|---|---|
| JP | S63-043333 | A | 2/1988 |
| JP | S63-129033 | A | 6/1988 |
| JP | H02-209245 | A | 8/1990 |
| JP | 2010-099997 | A | 5/2010 |
| JP | 2010-260296 | A | 11/2010 |
| JP | 2011-207091 | A | 6/2012 |
| SU | 1507406 | | 9/1989 |
| WO | 2014/083782 | | 6/2014 |
| WO | 2015/075073 | | 5/2015 |

OTHER PUBLICATIONS

Kim, et al: "Design and Fabrication of Electrostatic Inkjet Head using Silicon Micromachining Technology"; Journal of Semiconductor Technology and Science; vol. 8, No. 2, Jun. 2008, p. 121-127.
Office Action in Japanese Appl. No. 2018-505474 dated Jun. 2, 2020, 7 pages.

* cited by examiner

No bias voltage

With bias voltage and substrate motion

Figure 5 Sectional view in XZ of cleaning fluid manifold
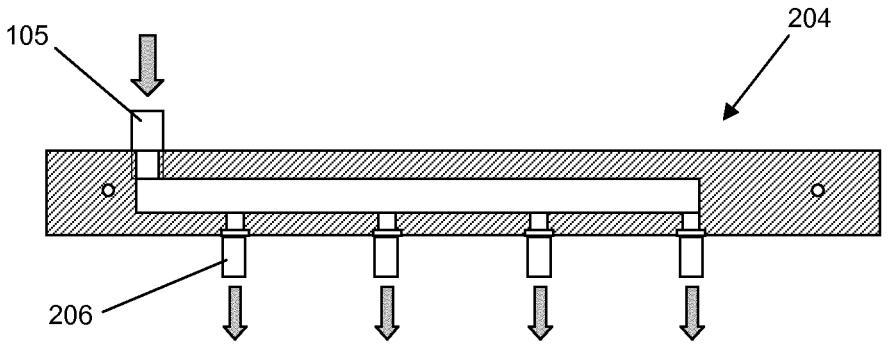
Figure 6 Sectional view in YZ of printhead
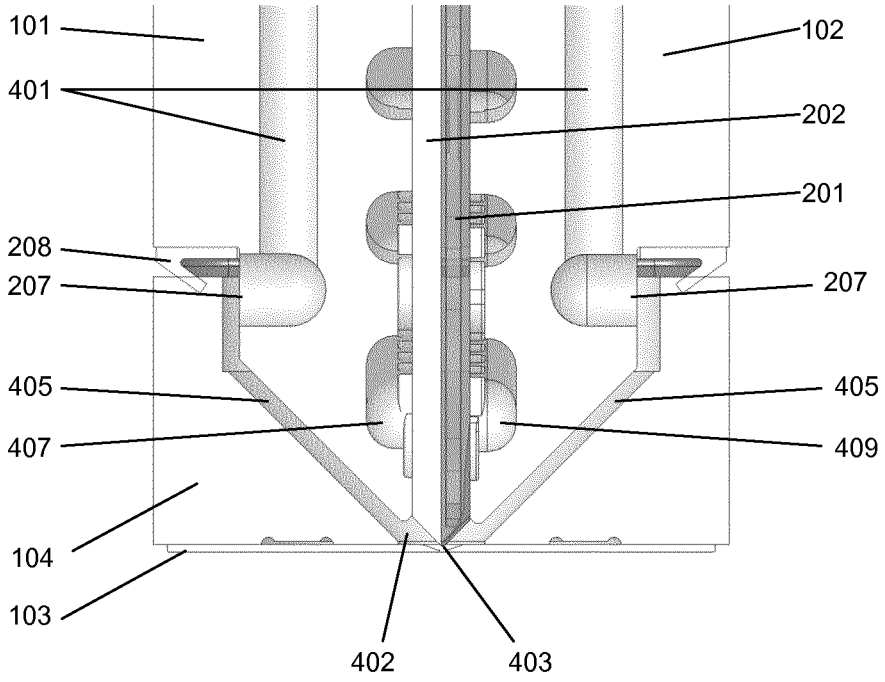

| | |
|---|---|
| 1102 | Sealed vessel vapour generator |
| 1104 | Outlet pipe |
| 1106 | Flow controller |
| 1108 | Valve |
| 1110 | Liquid |
| 1112 | Inlet pipe |
| 1114 | Bubbles |
| 1116 | head space |

| | |
|---|---|
| 1102 | Sealed vessel vapour generator |
| 1104 | Outlet pipe |
| 1106 | Flow controller |
| 1108 | Valve |
| 1110 | Liquid |
| 1112 | Inlet pipe |
| 1114 | Bubbles |
| 1116 | Head space |
| 1118 | Flow controller |

METHOD OF OPERATING AN INKJET PRINTHEAD

FIELD OF THE INVENTION

The present invention relates to electrostatic inkjet print technologies and, more particularly, to printheads and printers of the type such as described in WO/93/11866 and related patent specifications and their methods of operation.

BACKGROUND TO THE INVENTION

The general method of operation of the type of electrostatic printhead described in WO 93/11866 is well known. Electrostatic printers of this type eject charged solid particles dispersed in a chemically inert, insulating carrier fluid by using an applied electric field to first concentrate and then eject the solid particles. Concentration occurs because the applied electric field causes electrophoresis and the charged particles move in the electric field towards the substrate until they encounter the surface of the ink. Ejection occurs when the applied electric field creates a force on the charged particles that is large enough to overcome the surface tension. The electric field is generated by creating a potential difference between the ejection location and the substrate; this is achieved by applying voltages to electrodes at and/or surrounding the ejection location.

The location from which ejection occurs is determined by the printhead geometry and the location and shape of the electrodes that create the electric field. Typically, a printhead consists of one or more protrusions from the body of the printhead and these protrusions (also known as ejection upstands) have electrodes on their surface. The polarity of the bias applied to the electrodes is the same as the polarity of the charged particles so that the direction of the force is away from the electrodes and towards the substrate. Further, the overall geometry of the printhead structure and the position of the electrodes are designed such that concentration and ejection occur at a highly localised region around the tips of the protrusions.

The ink is arranged to flow past the ejection location continuously in order to replenish the particles that have been ejected. To enable this flow the ink must be of a low viscosity, typically a few centipoises. The material that is ejected is more viscous because of the higher concentration of particles due to selective ejection of the charged particles; as a result, the technology can be used to print onto non-absorbing substrates because the material will spread less upon impact.

Various printhead designs have been described in the prior art, such as those in WO 93/11866, WO 97/27058, WO 97/27056, WO 98/32609, WO 98/42515, WO 01/30576 and WO 03/101741.

Under certain conditions electrostatic printheads may exhibit a delay between the application of a train of voltage pulses applied to the printhead to initiate printing, and the actual start of ejection of ink from the printhead.

The occurrence of this delay can lead to a reduction of print quality, as the extended response time leads to the absence of printed ink in parts of the image.

The response time has been found to:

a) Increase in magnitude as ambient temperature is increased, indicating the effect is linked to the evaporation of inks at the ejectors; and b) Increase in magnitude as the time between applying the bias voltage to the ejectors and/or substrate motion, and applying the ejection pulse, is increased, indicating the effect is linked to the actions of the electric field on the ink near the tip, namely electrophoretic concentration and a drawing forward of the meniscus exposing more ink surface at the tip to air flow from the substrate motion.

Variability of the response time is difficult to correct via modifications to the printing pulse. Reducing or eliminating the delay, so that ejection is triggered reliably and controllably on application of a printing pulse, allows the printing of high quality images.

A delay in print start is thought to result from the formation of more viscous and/or pinned ink deposits at the ejector tip.

Under the application of the bias voltage, the ink surface meniscus is advanced forward towards the tip of the ejectors.

FIGS. 1*a* and 1*b* depict an ejector of an electrostatic printhead, comprising an upstand 400, the upstand 400 further comprising an ejection tip 410.

FIG. 1*a* shows the typical meniscus position in the absence of the bias voltage, in a position withdrawn from the ejection tip 410. FIG. 1*b* depicts the influence of the bias voltage on the location of the ink meniscus. The meniscus is shown in its advanced position when a bias voltage is applied. The meniscus surrounds the ejection tip 410 and a thin layer of ink is created at the region 403 of the ejection tip 410.

FIG. 1*b* depicts the two ink concentration mechanisms which may result in a slow response time, described in detail below. The meniscus is advanced by the bias voltage and an air flow is generated by motion of the substrate relative to the printhead. The application of the bias voltage also has the effect of concentrating the ink particles at the ejection tip through electrophoresis. The following two concentrating effects may occur, as shown in FIG. 1*b*.

1) The thin layer of ink surrounding the ejection tip 410 is subject to concentration through evaporation of the carrier fluid, due to the high surface-area to volume ratio, and due to the exposed position of the ink at the ejection tips 410. This concentrating effect would be expected to increase with increasing air flow past the printhead, generated by movement of the substrate relative to the printhead; and 2) Under the influence of the electric field produced by the application of the bias voltage, the charged ink particles will move electrophoretically and concentrate at the ejector tip 410, leading to a local increase in ink concentration and density.

It has been confirmed by experimental observations that the response time is greater when the printhead is held with a combination of applied bias voltage and motion of the substrate prior to printing.

FIG. 2 depicts the effect of the application of a bias voltage and/or motion of the substrate on the response time with increasing delay between the application of the bias voltage and/or substrate motion and initiating printing by applying a pulse voltage. Line 301 depicts the effect of motion of the substrate only and line 302 depicts the effect of the application of a bias voltage only. It can be seen that, individually, these factors cause little or no delay to the print start.

Line 303 depicts the effect of motion of the substrate in combination with the application of a bias voltage. As can be seen from FIG. 2, the magnitude of the response time with increasing delay between the application of the bias voltage and/or substrate motion, and initiating printing by applying a pulse voltage, is much greater than that caused by either factor alone.

A known approach to reducing the response time is to reduce or reverse the bias voltage between prints. This is considered to be effective by reversing the electrophoretic displacement of particles in the ink and/or withdrawing the ink meniscus from the tips of the printhead during non-printing, thereby preventing a concentrated layer of ink from forming at the ejection tip.

This approach has a significant benefit on improving the response time. However, there are some circumstances in which this may not be usable or sufficiently effective because it can only be performed prior to the printing of an image, not during printing. For example, for a large image where, because of the image design, certain ejectors are required to print for the first time a long way from the start of the image, the beneficial effect of bias voltage reduction or reversal at the start of the image may be reduced or lost by the time the ejector is required to print.

The response time is also known to depend on the chemistry of the ink, and may be improved by changes to ink formulation that control particle charging and dispersion stability, for example. However, such changes will tend to affect other aspects of ink performance such as droplet size and viscosity. A solution is therefore required that is ink independent.

While a combination of these approaches may improve a print start response, in some cases it is not reliably and sufficiently improved. As such, a more effective method for improving print start response time is needed.

US 2015/0151554 A1 describes a system for increasing the moisture content within the area of a printing system by providing a housing which houses the entire printing system, including the substrate conveying mechanism, and introducing humidified gas into the housing.

SUMMARY OF THE INVENTION

According to a first aspect of the invention, there is provided a method of operating an electrostatic ink jet printhead, the printhead comprising: one or more ejection tips from which, in use, ink is ejected, the tips defining a tip region; a printhead housing, the printhead housing defining a cavity in which the tips are located; the method comprising the step of, during a printing operation, passing a vapour into the cavity to reduce evaporation of ink in the tip region.

Advantageously, this method of operating an electrostatic printhead results in a substantial improvement in print start response, and in most cases elimination of a delay in print start. The passing of vapour into the cavity during a printing operation suppresses evaporation in the tip region, a necessary component in the cause of the delay. A constant condition at the tip region is maintained, and the viscosity of the ink at the tip region does not increase undesirably.

Further, the cavity, within which the ejection tips are located, is defined by the housing of the printhead itself. Advantageously, as the cavity comprises a part of the printhead itself, the volume of the cavity is relatively small meaning that only a small amount of vapour needs to be generated in order to fill the cavity so as to suppress evaporation in the tip region. If the housing were to house the entire printing system, including a substrate conveying mechanism as well as the printheads themselves, as with the system described in US 2015/0151554 A1, the volume of the cavity defined by the housing would clearly be much larger and correspondingly larger quantities of vapour would need to be generated.

A printing operation may include any time when the printhead is primed for printing, i.e. when ink is located at the ejection locations such that ink can be ejected from ejection locations. Further, a printing operation may include any time when ink is being ejected, and/or any time when a bias voltage is applied to the printhead.

Preferably, the method further comprises the step of, during a cleaning operation, passing a rinse fluid into the cavity to clean the one or more ejection tips.

The fluid passing into the cavity during a cleaning operation may be called a rinse fluid or a cleaning fluid. A rinse fluid or cleaning fluid typically comprises the ink carrier liquid (typically Isopar™ G). A rinse fluid or cleaning fluid may also comprise a charge control agent and/or a dispersant.

The vapour passed into the cavity to reduce evaporation and the rinse fluid may be supplied by separate tanks although, preferably, the vapour and the rinse fluid are supplied to the cavity from a common tank.

Advantageously, this reduces the number of components required to enable both the cleaning and the printing operations of the present method, thereby simplifying the design of the printhead and reducing the cost of construction.

The electrostatic ink jet printhead may further comprise at least two passages extending through the printhead housing to the cavity, one through which the vapour is passed to the cavity and one through which the rinse fluid is passed to the cavity. However, preferably, the printhead further comprises at least one passage extending through the printhead housing to the cavity, wherein both of the vapour and the rinse fluid are passed to the cavity via the at least one passage.

Advantageously, this reduces the number of passages required in the printhead housing to enable both the cleaning and the printing operations of the present method, thereby simplifying the design of the printhead and reducing the cost of construction.

The vapour may flow freely into the cavity although, preferably, the method further comprises the step of, during a printing operation, controlling the flow rate of vapour into the cavity using a first flow controller.

Advantageously, controlling the flow rate of vapour ensures the flow of vapour is sufficient to counteract the above outlined concentrating effects without adversely affecting the operation of the printhead. The vapour flow needs to be sufficient to counteract airflow into the printhead generated by the moving substrate, but not so high that it would deflect the ink ejection.

Preferably, the method further comprises the step of, during a printing operation, adding drying gas to the vapour prior to passing the vapour into the cavity.

The drying gas may be a dry gas, i.e. a gas which has not had any form of vapour added to it or which has had any vapour removed from it. For example, the drying gas may be supplied from a compressed air source and, therefore, would be substantially dry, with any residual vapour likely to be water. Adding a dry gas to the vapour reduces the vapour concentration of the vapour.

The drying gas may be any gas with a vapour concentration lower than that of the vapour passed into the cavity of the printhead housing.

The effect of adding the drying gas to the vapour is to reduce the vapour concentration of the vapour.

Advantageously, adding drying gas to the vapour prior to passing the vapour into the cavity reduces, and in some cases prevents, the occurrence of condensation on the internal surfaces of the printhead, by reducing the overall vapour concentration reaching the cavity. The occurrence of condensation can interfere with the operation of the printhead.

Preferably, the method further comprises the step of, during a printing operation, controlling the flow rate of drying gas added to the vapour using a second flow controller.

Advantageously, controlling the flow rate of the drying gas ensures the flow of drying gas is controllable to prevent the occurrence of condensation on the internal surfaces of the printhead whilst ensuring that the flow of vapour is still sufficient to counteract the above outlined concentrating effects.

Although other substances may be used, preferably, the vapour comprises a liquid diffused or suspended in a carrier gas.

Although different sources may be used, preferably, the carrier gas and the drying gas are supplied from a common source.

Preferably, the carrier gas comprises one or more of: air, dried air and nitrogen.

Preferably, the liquid comprises a hydrocarbon, wherein the hydrocarbon is preferably at least one of: an aliphatic hydrocarbon, a $C_1$-$C_{20}$ alkane, a branched $C_1$-$C_{20}$ alkane, hexane, cyclohexane, iso-decane, iso-unedecane, iso-dodecane, an isoparaffin, Isopar™ C and Isopar™ G.

Preferably, the rinse fluid comprises a hydrocarbon, wherein the hydrocarbon is preferably at least one of: an aliphatic hydrocarbon, a $C_1$-$C_{20}$ alkane, a branched $C_1$-$C_{20}$ alkane, hexane, cyclohexane, iso-alkane, iso-decane, iso-unedecane, iso-dodecane, an isoparaffin, Isopar™ C and Isopar™ G.

Isopar™ C and Isopar™ G are isoparaffinic fluids produced by the ExxonMobil™ company.

Although they may comprise different substances, preferably, the rinse fluid and the vapour both comprise the same substance.

Preferably, both of the rinse fluid and the vapour comprise one or more of an isoparaffin, a hydrocarbon, Isopar™ C and Isopar™ G.

Preferably, the vapour is substantially saturated.

According to a second aspect of the invention, there is provided an electrostatic ink jet printhead assembly comprising: one or more ejection tips from which, in use, ink is ejected, the one or more ejection tips defining a tip region; a printhead housing, the printhead housing defining a cavity in which the tips are located; and a tank configured to supply both a vapour and a rinse fluid to the cavity.

The electrostatic ink jet printhead may further comprise at least two passages extending through the printhead housing to the cavity, one through which the vapour is passed to the cavity and one through which the rinse fluid is passed to the cavity. However, preferably, the electrostatic ink jet printhead assembly further comprises at least one passage extending through the printhead housing to the cavity, wherein at least one passage is configured to transmit both of the vapour and the rinse fluid from the tank to the cavity.

The vapour may flow freely into the cavity although, preferably, the electrostatic ink jet printhead assembly further comprises a first flow controller configured to control the flow rate of vapour into the cavity.

According to a third aspect of the invention, there is provided an electrostatic ink jet printhead assembly comprising: one or more ejection tips from which, in use, ink is ejected, the one or more ejection tips defining a tip region; a printhead housing, the printhead housing defining a cavity in which the tips are located; a tank configured to supply a vapour to the cavity; and a first flow controller configured to control the flow rate of the vapour into the cavity.

Advantageously, controlling the flow rate of vapour ensures the flow of vapour is sufficient to counteract the above outlined concentrating effects without adversely affecting the operation of the printhead. The vapour flow needs to be sufficient to counteract airflow into the printhead generated by the moving substrate, but not so high that it would deflect the ink ejection.

Although the carrier gas and a drying gas may be provided by separate sources, preferably, the electrostatic ink jet printhead assembly further comprises a gas supply configured to supply a carrier gas to the tank and a drying gas for adding to the vapour.

Advantageously, this reduces the number of components required, thereby simplifying the design of the printhead and reducing the cost of construction. Further, adding a drying gas to the vapour reduces, and in some cases prevents, the occurrence of condensation on the internal surfaces of the printhead which can interfere with the operation of the printhead.

Preferably, the electrostatic ink jet printhead assembly further comprises a second flow controller configured to control the flow rate of the drying gas added to the vapour.

Advantageously, controlling the flow rate of drying gas ensures the flow of drying gas is controllable to prevent the occurrence of condensation on the internal surfaces of the printhead whilst ensuring that the flow of vapour is still sufficient to counteract the above outlined concentrating effects.

Preferably, the electrostatic ink jet printhead assembly further comprises a plurality of printheads, each printhead comprising a printhead housing, each printhead housing defining a cavity, wherein one or more ejection tips are located in each cavity and, wherein the tank is configured to supply both a vapour and a rinse fluid to each cavity.

BRIEF DESCRIPTION OF DRAWINGS

Embodiments of the present invention will now be described, by way of example only, with reference to the accompanying drawings, in which:

FIG. 5 is a sectional view of a manifold block within the printhead that directs fluids to different parts of the printhead;

FIG. 6 is a sectional view of the printhead showing the passages that direct fluids to the tip region of the printhead;

DETAILED DESCRIPTION

Figure 1A:
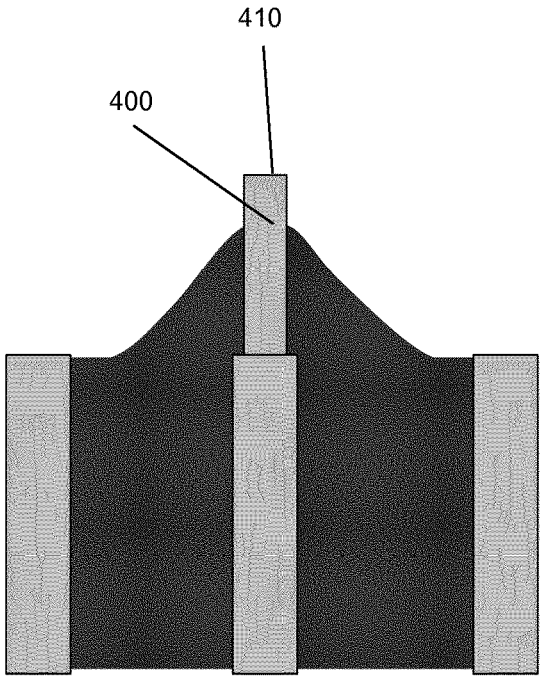
FIG. 1*a* depicts the tip of an example printhead showing the ink meniscus position before the application of a bias voltage.
Figure 1B:
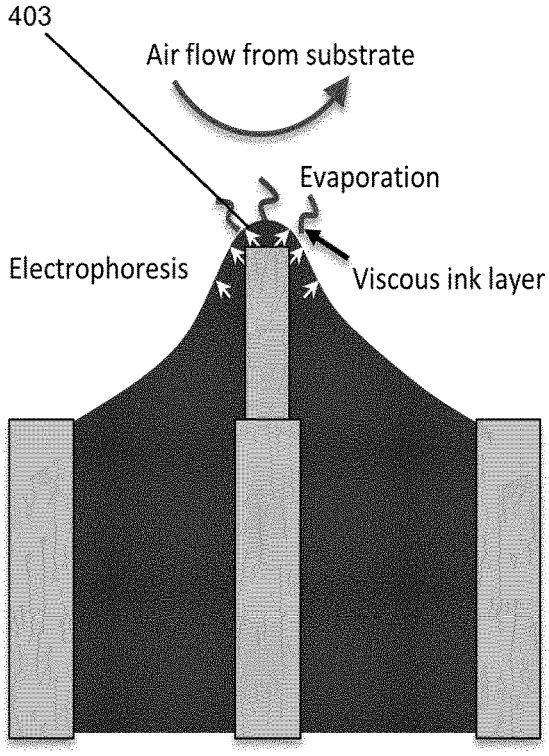
FIG. 1*b* depicts the same printhead tip showing the meniscus position with the bias voltage applied and showing the ink concentration mechanisms that can occur.
Figure 2:
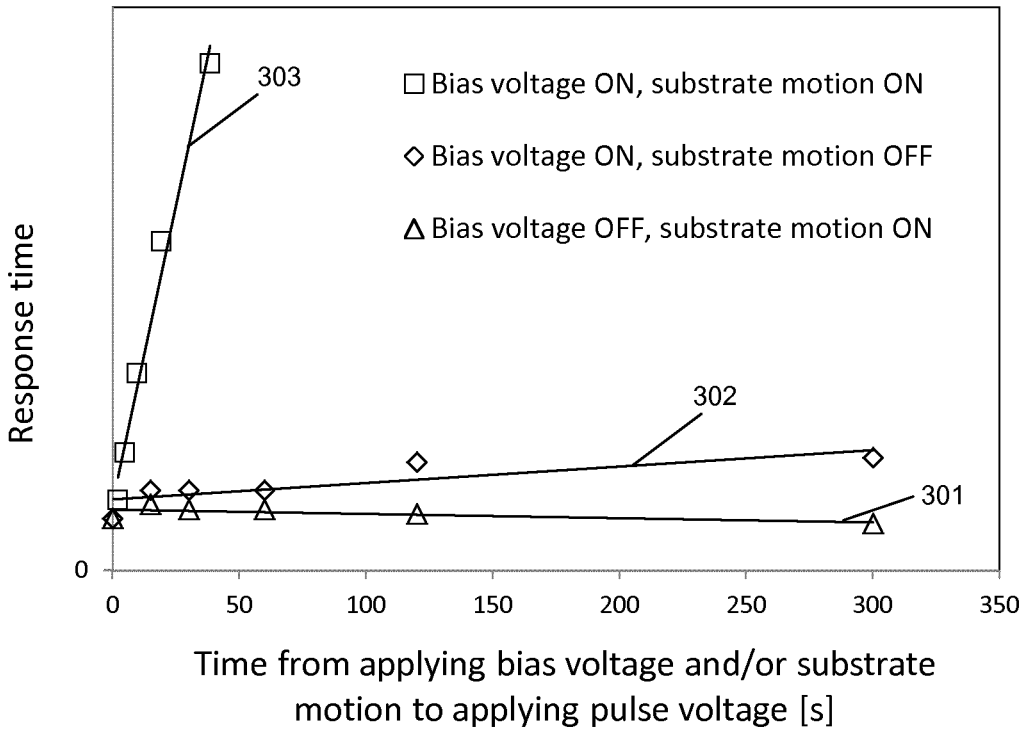
FIG. 2 is a graph which shows the effect of the application of a bias voltage and motion of the substrate on the response time with increasing delay between the application of the bias voltage and/or substrate motion and initiating printing by applying a pulse voltage.
Figure 3:
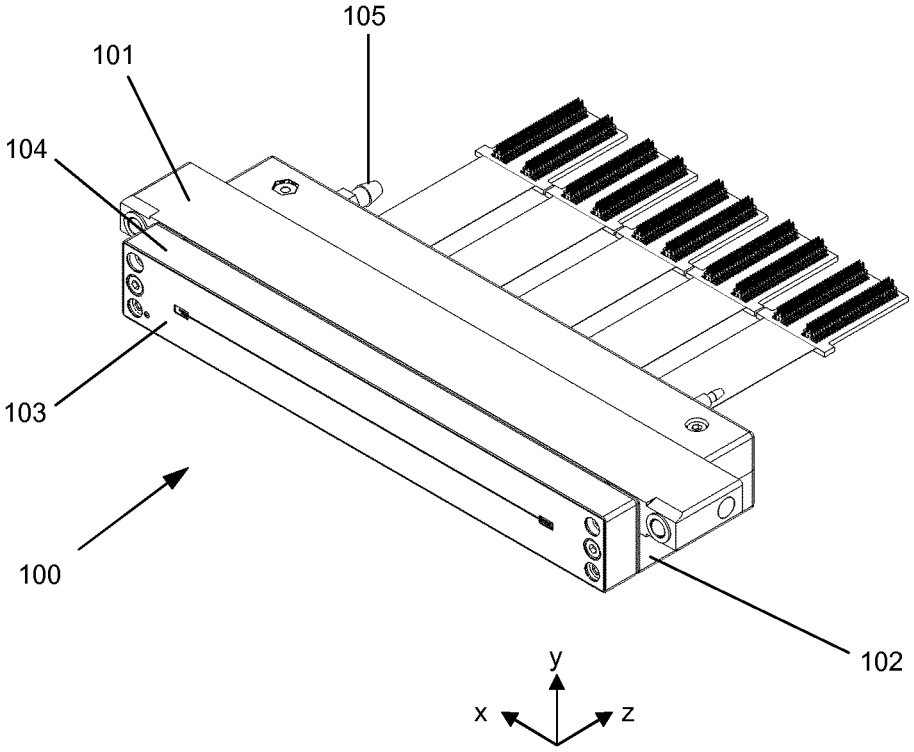
FIG. 3 is a perspective view of a printhead according to the present invention.
Figure 4:
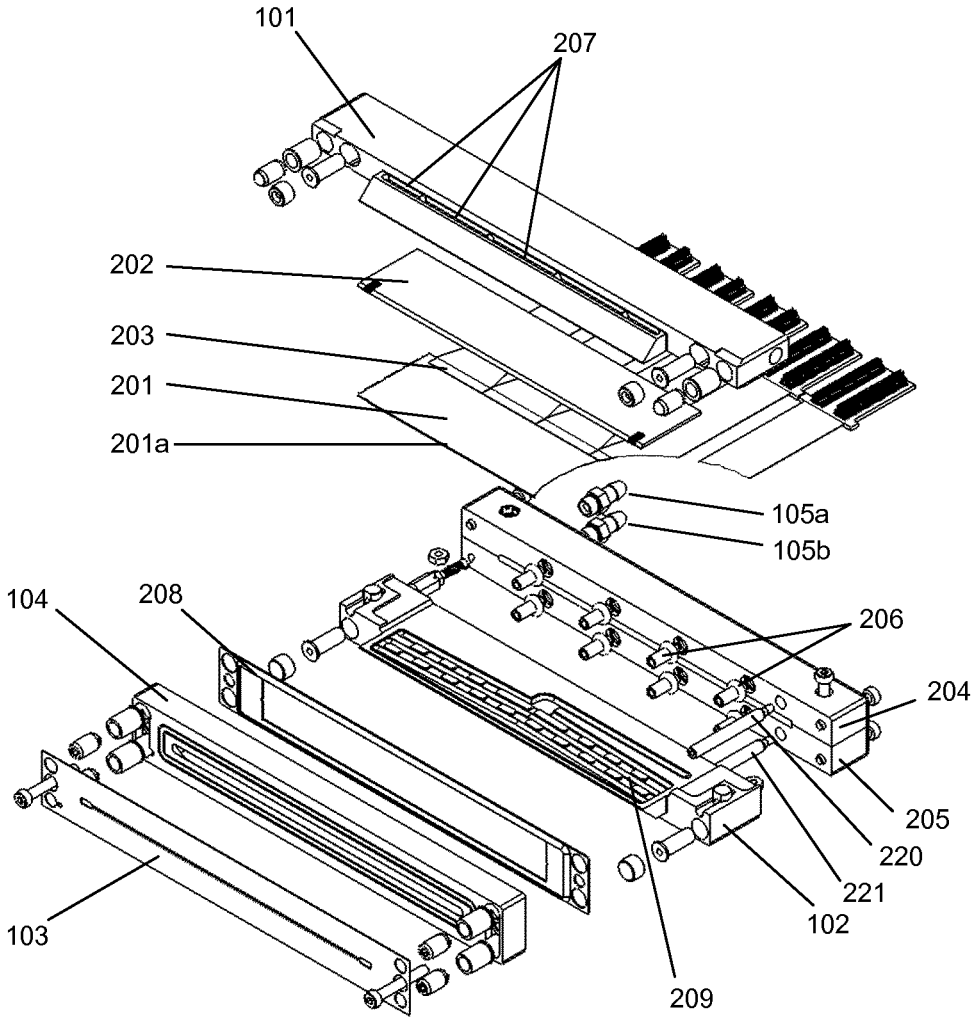
FIG. 4 is an exploded view of the printhead illustrated in FIG. 3.

An example of a printhead 100 according to the present invention, as shown in FIGS. 3, 4 and 6, comprising a two-part main body consisting of an inflow block 101 and an outflow block 102, between which are located a prism 202 and a central tile 201, the latter having an ejector tip array 410 formed along its front edge 201*a*. At the front of the printhead 100, an intermediate electrode plate 103 is mounted onto a datum plate 104, which in turn is mounted onto the inflow block 101 and the outflow block 102 of the printhead 100. The datum plate 104 defines a cavity 402, shown in FIG. 6, within which the ejection tips 410 are housed. The region within which the ejection tips are located is the ejection location or tip region 403. As such, the datum plate 104 can be considered to be a printhead housing 104 defining a cavity 402 in which the ejection tips 410 are located. A gasket 208, shown in FIG. 5, is provided between the datum plate 104 and the inflow and outflow blocks 101 and 102.

Referring to FIGS. 4, 5, 6, 7 and 8, the main body of the printhead 100 comprises the inflow block 101 and the outflow block 102, sandwiched between which are the prism 202 and the central tile 201. The central tile 201 has an array of ejection tips 410 along its front edge 201*a* and an array of electrical connections 203 along its rear edge.

Figure 8:
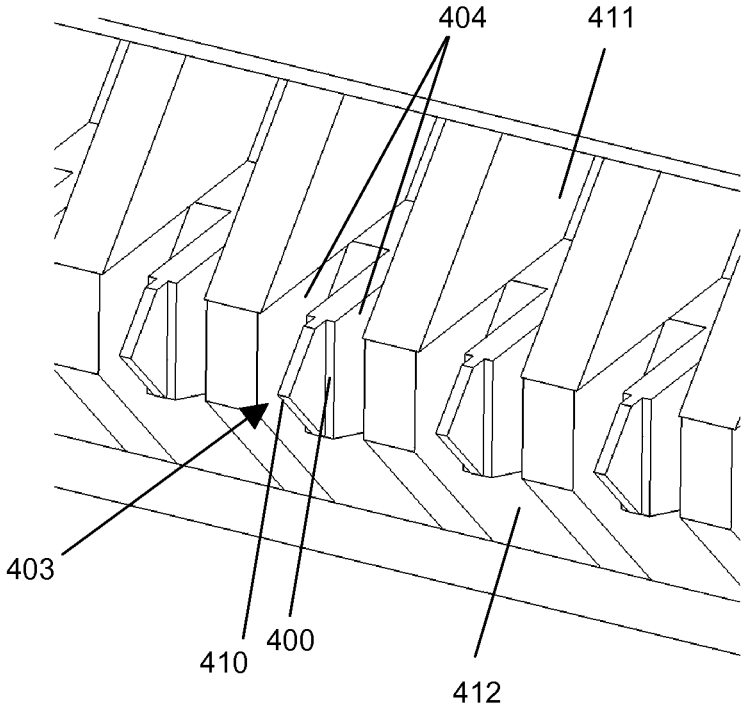
FIG. 8 is a three-dimensional close-up illustration of the ejection region of the printhead illustrated in FIG. 3.

As clearly shown in FIG. 8, each ejection tip 410 is disposed at an end of an upstand 400 with which an ink meniscus interacts (in a manner well known in the art). On either side of the upstand 400 is an ink channel 404 that carries ink past both sides of the ejection upstand 400. In use, a proportion of ink is ejected from the ejection locations 403 to form, for example, the pixels of a printed image. The ejection of ink from the ejection locations 403 by the application of electrostatic forces is well understood by those of skill in the art and will not be described further herein.

Figure 7:
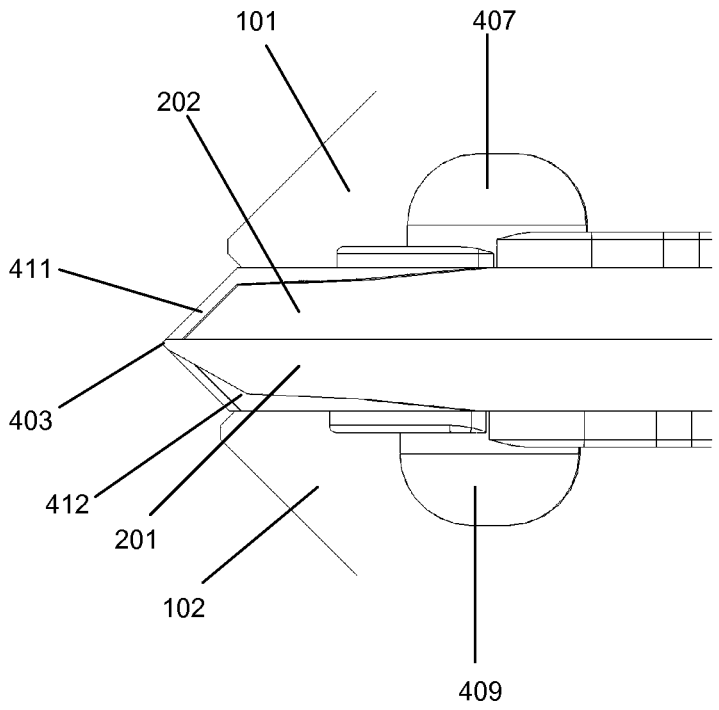
FIG. 7 is a detailed cross-sectional view of the ejection region of the printhead illustrated in FIG. 3.

The prism 202, shown in FIG. 7, comprises a series of narrow channels 411, corresponding to each of the individual ejection locations 403 associated with each of the ejection tips 410 along the front surface 201*a* of the central tile 201. The ink channels of each ejection location 403 are in fluid communication with the respective channels of the prism 202, which are, in turn, in fluid communication with a front portion 407 of the inlet manifold formed in the inflow block 101 (said inlet manifold being formed on the underside of the inflow block 101 as it is presented in FIG. 4 and thus not shown in that view). On the other side of the ejection locations 403, the ink channels 404 merge into a single channel 412 per ejection location 403 and extend away from the ejection locations 403 on the underside (as shown in FIG. 7) of the central tile 201 to a point where they become in fluid communication with a front portion 409 of the outlet manifold 209 formed in the outflow block 102.

The ink is supplied to the ejection locations 403 by means of an ink supply tube 220, shown in FIG. 4, in the printhead 100 which feeds ink into the inlet manifold within the inflow block 101. The ink passes through the inlet manifold and from there through the channels 411 of the prism 202 to the ejection locations 403 on the central tile 201. Surplus ink that is not ejected from the ejection locations 403 in use then flows along the ink channels 412 of the central tile 201 into the outlet manifold 209, shown in FIG. 4, in the outflow block 102. The ink leaves the outlet manifold 209 through an ink return tube 221, shown in FIG. 4, and passes back into the bulk ink supply.

The channels 411 of the prism 202 which are connected to the individual ejection locations 403 are supplied with ink from the inlet manifold at a precise pressure in order to maintain accurately controlled ejection characteristics at the individual ejection locations 403. The pressure of the ink supplied to each individual channel 411 of the prism 202 by the ink inlet manifold is equal across the entire width of the array of ejection locations 403 of the printhead 100. Similarly, the pressure of the ink returning from each individual channel 412 of the central tile 201 to the outlet manifold 209 is equal across the entire width of the array of ejection locations 403 and precisely controlled at the outlet, because the inlet and the outlet ink pressures together determine the quiescent pressure of ink at each ejection location 403.

The printhead 100 is also provided with an upper 204 and a lower 205 fluid manifold, shown in FIG. 4. The upper and lower fluid manifolds have respective inlets 105*a*, 105*b* through which fluid, such as cleaning fluid, rinse fluid or a vapour (as described in detail below) can be supplied to the printhead 100. The inflow 101 and outflow 102 blocks are both provided with fluid passages 401, shown in FIG. 6. The passages in the inflow block 101 are in fluid communication with the upper fluid manifold 204 and those passages in the outflow block 102 are in fluid communication with the lower fluid manifold 205. Fluid connectors 206, shown in FIG. 5, link the fluid manifolds 204 and 205 to the respective fluid passages 401.

The fluid passages 401 within the inflow 101 and outflow 102 blocks end at fluid outlets 207, as shown in FIG. 6. The pathway to the ejection locations 403 continues along enclosed spaces 405 defined by the V-shaped cavity 402 defined by the datum plate 104 and the outer surfaces of the inflow 101 and outflow 102 blocks, until it reaches the point at which the ejection tips 410 lie within the cavity 402. The two sides of the V-shaped cavity are, in this example, at 90 degrees to each other.

Figure 9:
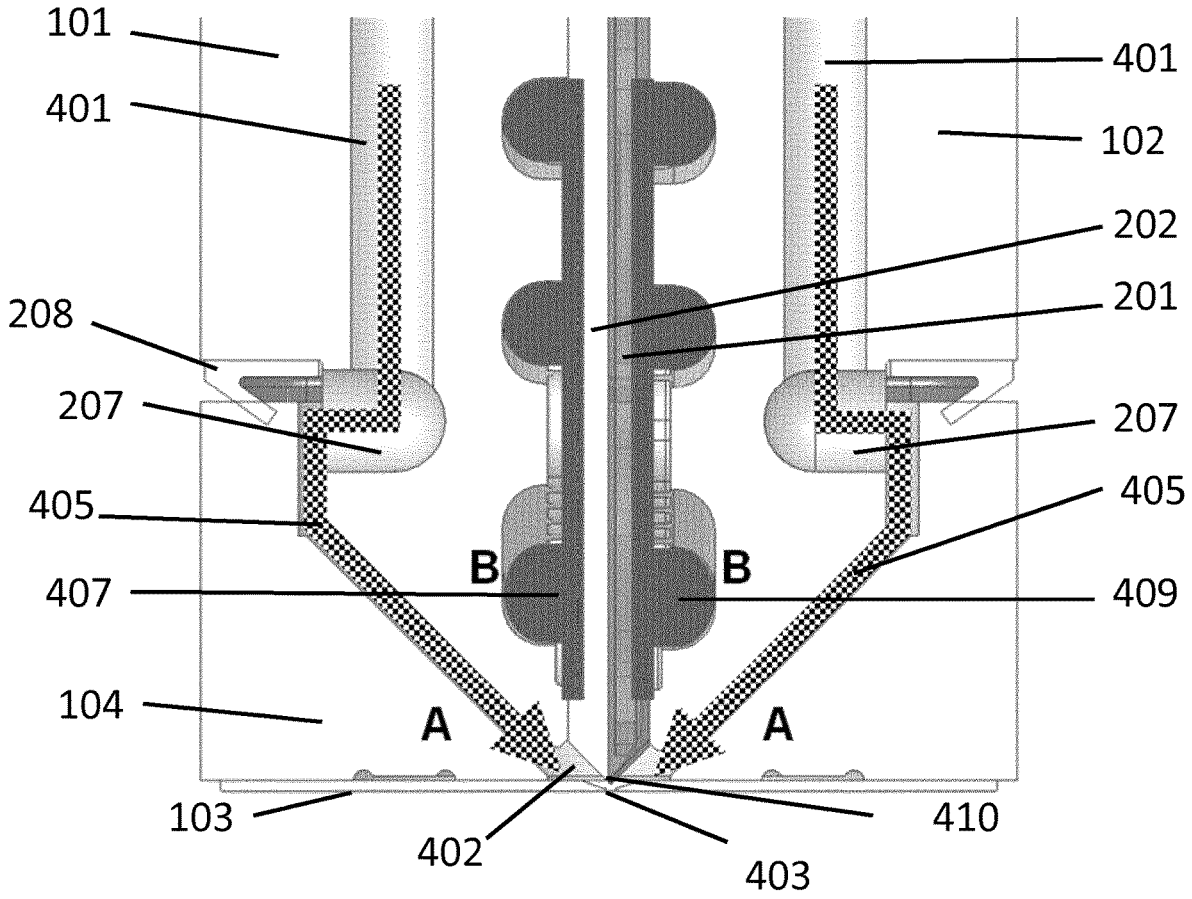
FIG. 9 is the same view as FIG. 3, but with fluid flow paths indicated.

FIG. 9 depicts the printhead 100 shown in FIG. 6 during a cleaning operation. As can be seen in FIG. 9, arrows A show the fluid pathways taken by the rinse/cleaning fluid and/or gas during cleaning of the printhead 100. This same path may be taken by a vapour during the below described method of operation for improved response time. Regions B show the pathways taken by the ink through the inlet and outlet manifolds and along ink channels 411 and 412.

During a normal printing operation, a flow of ink exists around the ejection tips 410 from the inlet side (inlet block 201) to the outlet side (outflow block 202). During a normal printing operation, there is no flow of cleaning/rinse fluid—indeed no cleaning/rinse fluid is present in the printhead 100.

However, during a cleaning operation, ink flow is stopped by setting the inflow and outflow pressures to be equal, and rinse fluid is supplied through passages 401 and into cavity 402 to clean the tips 410 and the intermediate electrodes 103. Ink may remain in the printhead during this operation, i.e. the printhead remains primed but, because flow is stopped, rinse fluid is not drawn into the printhead and mixing of rinse fluid with ink is minimal. During a cleaning operation, gas may also be supplied through passages 401 and into cavity 402 to dry the tips 410 and the intermediate electrodes 103 of cleaning/rinse fluid. The gas used may be air or, preferably, dry air.

When cleaning is complete, ink flow around the ejection tips 410 is re-established from the inflow to the outflow side of the printhead 100.

A maintenance cap, such as the maintenance cap described in EP2801480, may be attached to the face of the printhead 100 during a cleaning operation.

Figure 10:
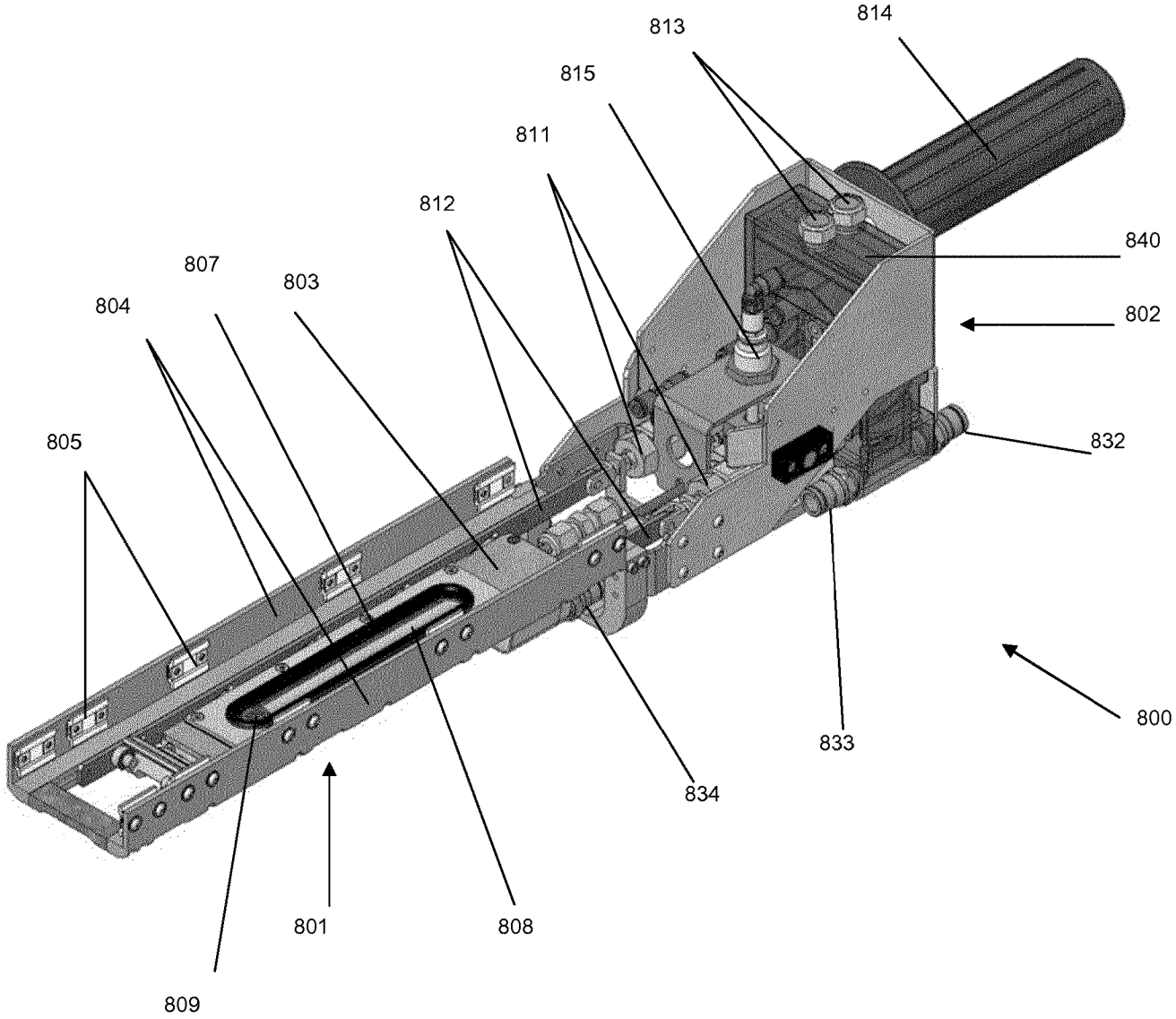
FIG. 10 shows an example of a maintenance cap for use in a cleaning operation.

An example of a maintenance cap that can be used during cleaning of the ejection tips is shown in FIG. 10.

Figure 11:
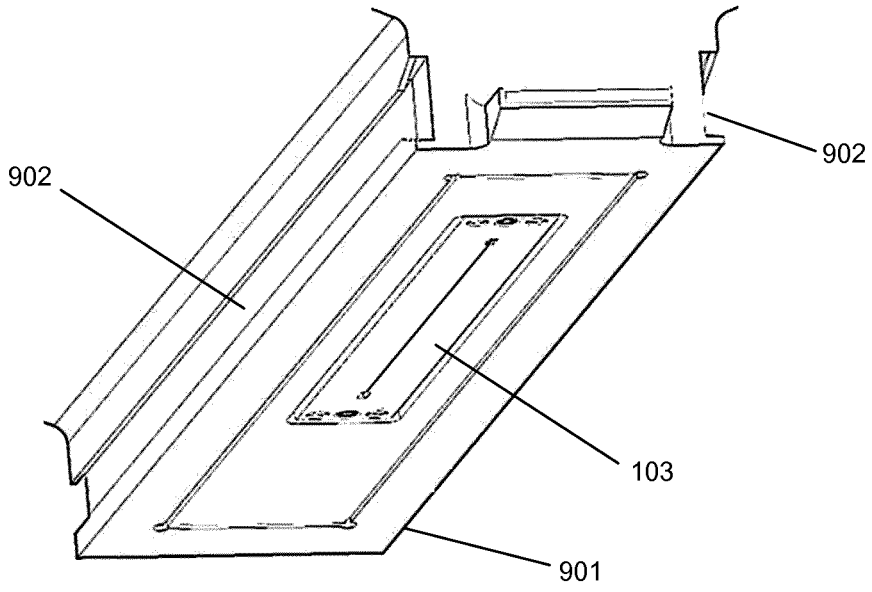
FIG. 11 shows an example of a printhead module outer casing with which the maintenance cap engages.

The maintenance cap 800 includes a printhead engaging section 801 and an engagement section 802, which in this example is a clamping engagement. The printhead engaging section 801 includes a base section 803 and upstanding side walls 804. The side walls 804 include linear keyway bearings 805 which engage with a corresponding profile 902 on a printhead module outer casing 901, shown in FIG. 11. The side walls 804 could be replaced with, or used together with, other means of mounting the cap 800 on the printhead 100. This is especially true if multiple printheads are provided and the same cap is used to cover more than one of the printheads at the same time. The cap 800 may also be provided with a fitting handle 814 to help with the initial installation of the cap 800 in the printer (although thereafter the cap is controlled automatically).

The base section 803 comprises a tank on which a printhead seal 807 is mounted. The tank has an opening 808 into which, in use, rinse fluid is drained from the printhead 100 through the slot in the intermediate electrode 103, the opening 808 defining a cavity within the tank. The opening 808 is surrounded by the seal 807. To attach the maintenance cap 800 to the printhead 100 to be cleaned, the printhead 100 is placed above the tank, in engagement with the seal 807. Beneath the seal 807, on the opposite side of the opening 808, a movable spray head 809 is provided, mounted on a pair of spray head guides. The function of the spray head 809 is to clean the outer face of the intermediate electrode 103 by directing fine jets of rinse fluid thereon.

A rinse fluid can also be called a cleaning fluid. A rinse fluid or cleaning fluid typically comprises the ink carrier liquid (an example being Isopar™ G, produced by ExxonMobil™). A rinse fluid or cleaning fluid may also comprise a charge control agent and/or a dispersant.

In operation, the maintenance cap is inserted across the front of the printhead 100 and clamped or otherwise fastened against the outer face of the intermediate electrode 103 forming a fluid-tight seal. The printhead ink pathways remain filled with ink during the cleaning process and the cleaning action is confined to the tip region 403 of the printhead 100. The cap 800 collects and drains rinse fluid from the printhead 100 during a cleaning operation, the fluid preferably being drained to a tank in a fluid management system remote from and lower than the printhead 100.

As a result of the sealed engagement between the cap 800 and the printhead 100, the draining action from the maintenance cap 800 could create a partial vacuum within the maintenance cap 800 that would draw the ink out of the printhead 100. A further preferred feature is a baffled venting system, which can prevent this. The system includes one or more, in this case two, air vents 813, and these vents allow equalisation of air pressure between the inside of the maintenance cap and the surrounding atmosphere, and prevents the escape of rinse fluid through the vent by incorporating a series of baffles.

Figure 12:
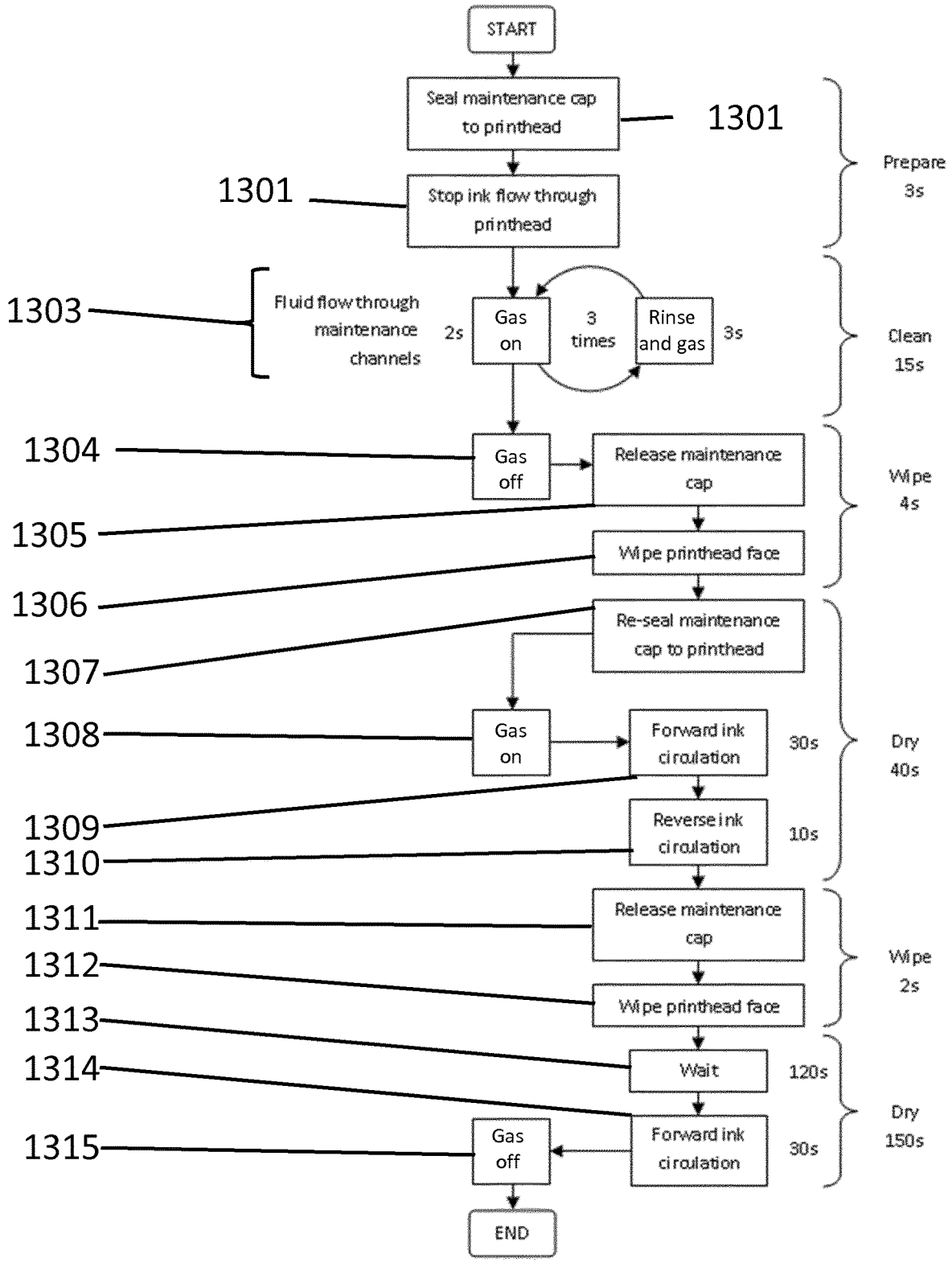
FIG. 12 is a flow chart describing the stages of a cleaning operation.

An example cleaning operation is shown in FIG. 12 and is described as follows:

1. START: When a printhead cleaning operation is called for, either through automatic scheduling or operator intervention, printing is stopped, the printhead 100 moved away from the substrate (or the substrate moved depending on the type of printer), and a maintenance cap 800 is sealed to the face of the printhead 100 (step 1301).
2. Ink flow around the printhead 100—a constant feature of the printhead 100 during a printing operation, controlled by difference in ink pressures between ink inlet and outlet ports of the printhead 100—is stopped by setting equal pressures at the inlet and outlet ports, at the mid-point of the normal operating pressures (step 1302).
3. Gas under slight positive pressure is supplied to the fluid inlets 105*a* and 105*b* via an external control valve (step 1303). The gas passes through the upper and lower fluid manifolds 204, 205, where it is distributed via fluid connectors 206 to eight passages 401 spaced evenly across the width of the printhead 100: four on the upper side and four on the lower side. It emerges from fluid outlets 207 into the cavity 402 in the datum plate 104 near the front of the printhead 100 and within which the ejection tips 410 and the inner face of the intermediate electrode 103 are located. The gas pressure in the cavity 402 is slightly higher than that of the atmosphere external to the printhead 100 or in the maintenance cap 800 because the narrow slot in the intermediate electrode 103 presents a restriction to the flow of gas out of the printhead 100. The higher gas pressure is not sufficient to force the ink backwards out of the printhead 100, but causes it to retreat from the tip region enough to expose the ejection tips 410. The gas used may be air or, preferably, dry air.
4. A rinse fluid-gas mixture is periodically directed through the fluid passages 401 in short bursts, controlled via an external control valve. Typical timings are: gas 2*s*; rinse & gas 3*s*; gas 2*s*; rinse & gas 3*s*; gas 2*s*; rinse & gas 3*s*; gas 2*s* (step 1303). The timings have been found to provide effective cleaning whilst minimising the amount of rinse fluid that enters the ink channels. Rinse fluid flows from the cavity 402 through the open slot in the centre of the intermediate electrode 103 into the maintenance cap 800 from where it is drained.
5. Gas is turned off (step 1304) and the maintenance cap 800 is released (step 1305), allowing a wiper to be drawn across the outside face of the intermediate electrode 103 to remove 30 any drips (step 1306). The cap 800 is re-sealed to the printhead 100 (step 1307).
6. The gas supply is turned on again to start drying the internal faces of the printhead 100 (step 1308). Gas flows through the spaces 405 and the cavity 402 and into the maintenance cap 800 from where it is vented.
7. Ink flow around the printhead 100 is re-established by setting a pressure difference between the inlet and outlet ports of the printhead 100. Flow is established in the forward direction (inlet to outlet) for 30 s (step 1309), then reversed by swapping the pressures at the inlet and outlet ports (step 1310), which has the effect of expelling any gas trapped in the ink channels from the cleaning process.

8. In this state, the maintenance cap 800 is released again (step 1311) and the outside face of the intermediate electrode wiped again to remove residual drips of rinse fluid (step 1312), and the maintenance cap withdrawn completely from the printhead 100.

9. There follows a further drying phase of 150*s* in total (step 1313), after 120 s of which the ink flow is restored to the forward direction (step 1314). The gas is then turned off (step 1315).

10. The pressures are controlled such that the ink pressure at the ejection tips 410 is just below that of the atmosphere surrounding the tips so that the ink flow is confined in the channels 404 each side of the ejection tips 410 and the ink meniscus pins to the tips and edges of the channels 404.

11. END

During a printing operation in accordance with the present method to improve response time, the fluid passages 401 within the inflow 101 and outflow 102 blocks are used to supply a vapour to the cavity 402 defined by the datum plate 104, within which the ejection tips 410 lie, while a flow of ink exists around the ejection tips 410 from the inlet side (inlet block 201) to the outlet side (outflow block 202).

A printing operation may include any time when the printhead 100 is primed for printing, i.e. when ink is located at the ejection locations 403 such that ink can be ejected from ejection locations 403. Further, a printing operation may include any time when ink is being ejected, and/or any time when a bias voltage is applied to the printhead 100 and/or any time when the substrate is moving relative to the printhead.

Figure 13:
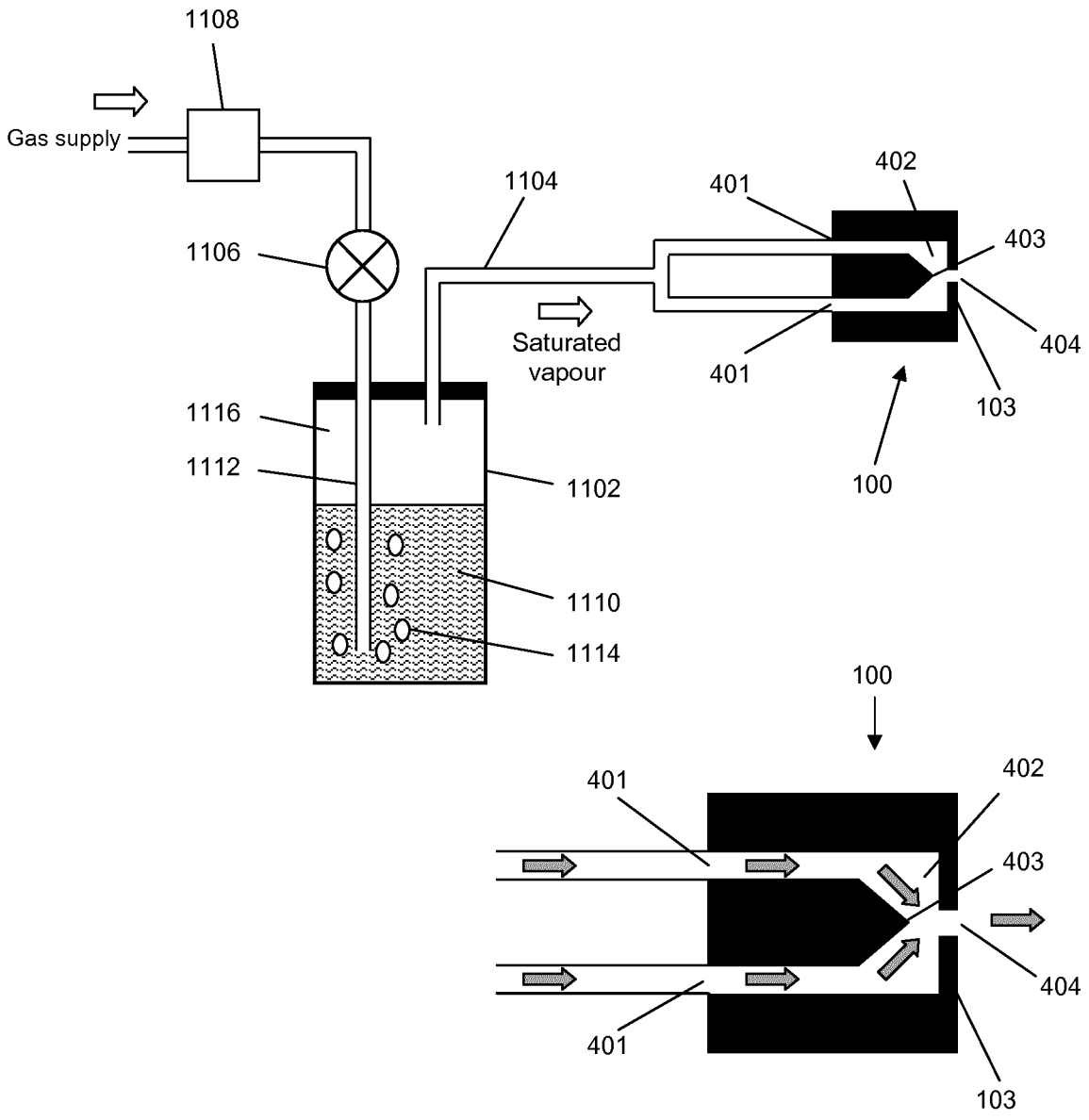
FIG. 13 shows a schematic of a method employed during a printing operation to improve response time.

A schematic of the method for improving response time is shown in FIG. 13.

A vapour is produced by bubbling carrier gas through a volume of liquid 1110 contained in a tank in the form of a sealed vessel 1102 (vapour generator) with an outlet pipe 1104. The flow of gas into the vapour generator 1102 emerges within the liquid 1110 from the submerged inlet pipe 1112, creating bubbles 1114 in the liquid 1110 to increase the surface area of the liquid-gas interface. The flow of gas into the vapour generator 1102 may be derived from a compressed gas source and controlled using a first flow controller 1106, set to deliver a controlled flow rate. A typical flow rate of 0.5 l/min is used but this may be varied according to, for example, the speed of relative motion between the printhead and the substrate, or the ambient temperature. The first flow controller 1106 may be controllable, for example, by a printhead controlling computer (not shown), to deliver a flow rate of gas that is dependent on the operating conditions. Because the vessel 1102 is sealed, the output flow rate of vapour from the vessel 1102 is substantially equal to the input flow rate of gas which is governed by the first flow controller 1106.

Figure 16:
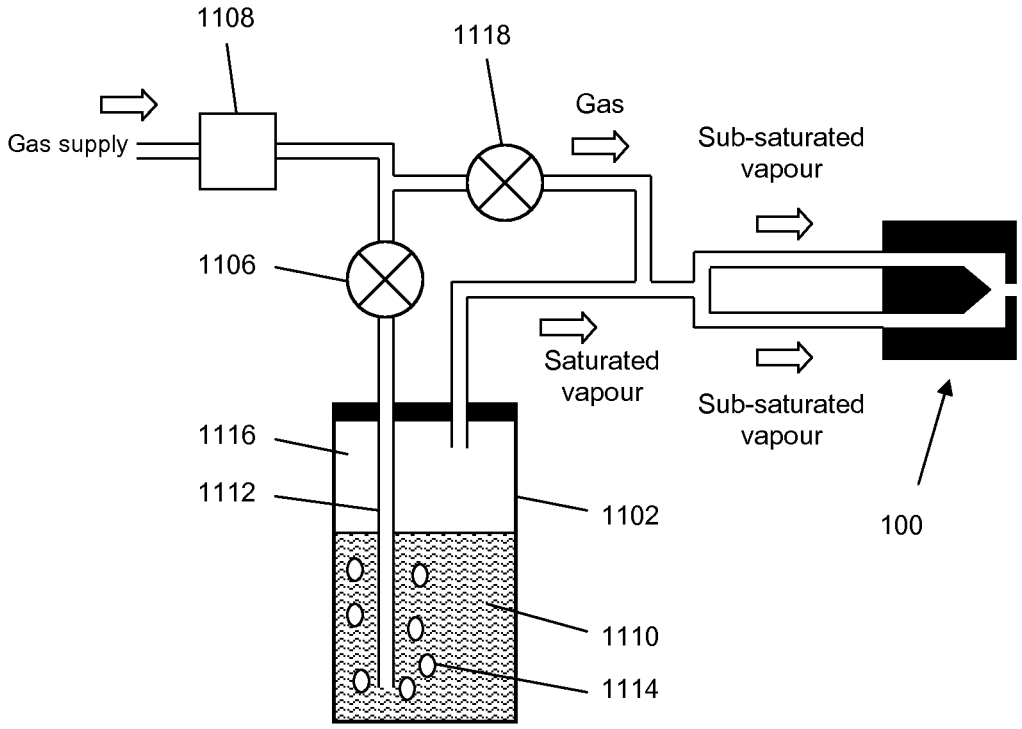
FIG. 16 shows a modified schematic of the method employed during a printing operation to reduce response time.

Although the first flow controller 1106 is depicted in FIGS. 13 and 16 as being disposed between the gas source and the vapour generator 1102, it may be located anywhere along the fluid connection between the gas source and the printhead 100.

For example, the first flow controller 1106 may be disposed along the outlet pipe 1104 between the vapour generator 1102 and the printhead 100.

Optionally, where the first flow controller 1106 is disposed along the outlet pipe 1104 between the vapour generator 1102 and the printhead 100, a pressure regulator may be added between the gas source and the vapour generator 1102, i.e. where the first flow controller 1106 is shown in FIGS. 13 and 16, to prevent any build-up of pressure in the vessel 1102.

It will be understood that, wherever the first flow controller 1106 is placed along the fluid connection between the gas source and the printhead 100, it will have the same effect of controlling the flow rate of vapour to the internal cavity 402 of the printhead 100.

A valve 1108 can be used to switch on or off the flow of gas into the vapour generator and hence the flow of vapour out of it. The valve 1108 may be controlled, for example by a printhead controlling computer (not shown), to be switched on at the start of a printing operation and switched off again at the end of the printing operation.

The saturation level of Isopar™ G vapour generated by this apparatus can be determined by measuring the rate of mass loss of liquid Isopar™ G in the vessel 1102 as a function of gas flow rate into the vessel 1102. This has been found to be linear over the measured range of 0.2 to 10 litres of gas (air) per minute, with a concentration of approximately 16 mg/l. The fact that the vapour concentration is not dependent on gas flow rate over this range is consistent with the vapour being saturated for all gas flow rates over this range. The advantages of this are many, and include: the composition of a saturated vapour is stable; it is unnecessary to monitor the composition of the vapour in use, simplifying the apparatus; the fully saturated vapour will completely prevent evaporation at the surface of a liquid and is therefore the most effective vapour composition for use in the printhead; the flow rate of the vapour to the printhead can be variably controlled without affecting the composition of the vapour; a variable number of printheads can be supplied with an equal flow rate to each from one vapour generator without affecting the vapour composition.

A controlled gas flow can be achieved using a source of clean compressed gas with locally regulated pressure (such as is commonplace in laboratories, factories and other industrial facilities where an electrostatic inkjet printer may be installed), followed by a flow rate adjuster, which is the flow rate controller 1106.

These commonly combine an adjustable flow restriction valve with a flow rate indicator, enabling the desired flow rate to be set.

The vapour is collected from the head space 1116 of the vessel 1102 via the outlet pipe 1104, and directed through the fluid passages 401, also used for introducing cleaning fluid and drying gas to the printhead 100 during cleaning operations; and The vapour flows through the internal cavity 402 of the printhead 100, passing the ejector tip region 403 and finally exiting the printhead 100 through the slot 404 in the intermediate electrode plate 103.

Although the vapour is passed through the same fluid passages 401 as the rinse fluid and drying gas, it will be understood that a separate, dedicated passage or passages may be provided in the body of the printhead 100 suitable for delivering vapour to the cavity 402 of the printhead 100.

Suitable vapour includes, but is not limited to, vapours produced from the following liquids:

1. Isopar™ G, as supplied by ExxonMobil™;
2. Isopar™ C, as supplied by ExxonMobil™;
3. Any other grade of Isopar™ (i.e. E, H, J, K, L or M), as supplied by ExxonMobil™;
4. The carrier fluid of the ink;
5. The rinse fluid;
6. An alternative isoparaffinic liquid to (1) or (2), consisting of a range of alkane chain lengths in the $C_1$-$C_{20}$ range 7. Any other hydrocarbon liquid; and
8. Any other vapour that inhibits evaporation of the ink.

Isopar™ C is defined as an isoparaffinic fluid with a boiling point in the range 95-110° C. and density in the range 0.68 to 0.72 g/ml.

Isopar™ G is defined as an isoparaffinic fluid with a boiling point in the range 155-180° C. and density in the range 0.73 to 0.76 g/ml.

More generally iso-paraffinic fluids with a boiling point in the range of 95–220° C. and a density in the range 0.68 to 0.79 g/ml, such as the various grades of Isopar™ produced by the ExxonMobil™ corporation, are suitable for use as suitable liquid for producing the vapour.

Fluids from this range are also suitable for use as a rinse fluid and/or as a carrier liquid for inks (described below) in addition to being suitable for use as a liquid for producing vapour.

Suitable carrier gas for the vapour includes, but is not limited to:
1. Air, typically ambient air;
2. Dried air; and
3. Nitrogen.

Certain gases (e.g. Helium) are also known to reduce evaporation rates of liquids compared to the evaporation rate in air, and may hence be used advantageously in the invention, either alone or in combination with a vapour.

The vessel 1102 shown in FIGS. 13 and 16 may be used to supply vapour to multiple cavities 402 within the printhead 100 and/or within multiple printheads 100. For example, the vessel 1102 may be configured to supply both a vapour and a rinse fluid to each cavity of a plurality of printheads 100, each printhead 100 comprising a printhead housing 104, each printhead housing 104 defining a cavity 402, wherein one or more ejection tips 410 are located in each cavity 402. The vessel 1102 could be located remotely from the printhead or printheads 100. Where a plurality of printheads 100 are present, each of the printheads 100 may be located remotely from one another.

Figure 14:
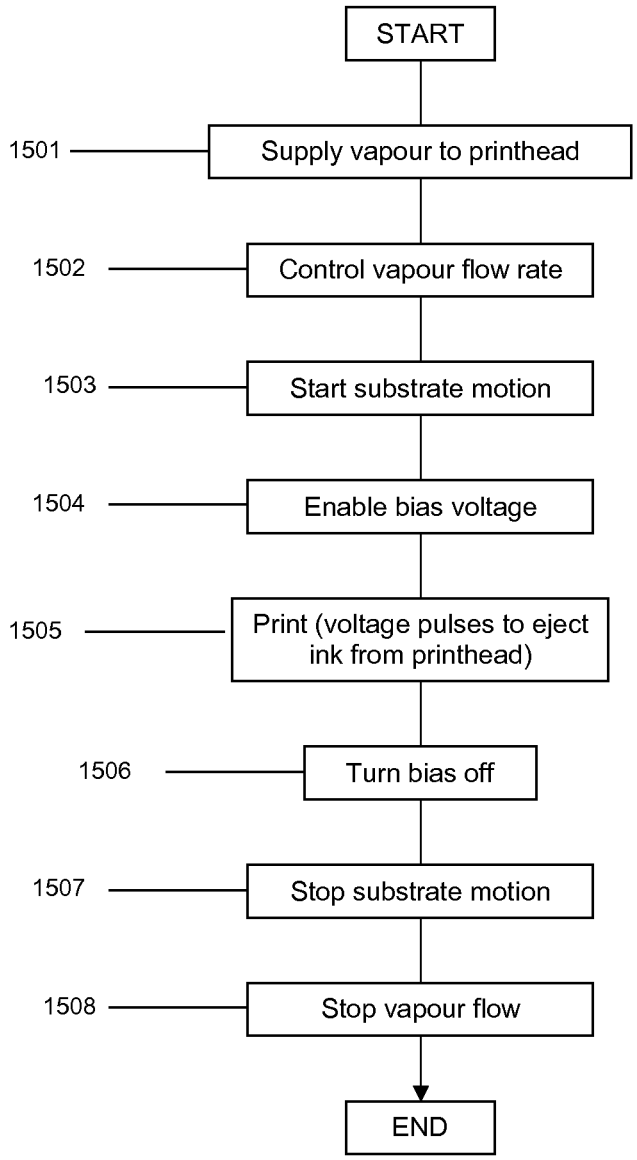
FIG. 14 is a flow chart describing the stages of the printing operation.

An example printing operation implementing the method for improving response time is shown in FIG. 14 described as follows:

1. START: The head maintenance cap 800 (if fitted) is withdrawn from the printhead 100 and ink is caused to flow around the printhead 100 in preparation for a print operation. The ink pressures at the inlet and outlet of the printhead 100 are controlled such that the ink pressure at the ejection tips 410 is just below that of the atmosphere surrounding the ejection tips 410 so that the ink flow is confined in the channels 404 each side of the ejection tips 410 and the ink meniscus pins to the ejection tips 410 and edges of the channels 404.
2. Vapour is supplied at a controlled flow rate to the fluid inlets 105*a* and 105*b* from a sealed vessel 1102 containing liquid, through which gas is bubbled to create vapour (steps 1501 and 1502)).
3. The vapour passes through the upper and lower fluid manifolds 204, 205, where it is distributed via fluid connectors 206 to passages 401 spaced evenly across the width of the printhead 100. The vapour passes from the fluid outlets 207 into the cavity 402 defined by the datum plate 104 near the front of the printhead 100 and within which the ejection tips 410 and the inner face of the intermediate electrode 103 are located.
4. Vapour may be passed into the cavity 402 for the duration of the printing operation. Alternatively, the vapour may be passed all of the time, whether the printhead 100 is printing or not. The vapour could also be passed intermittently.
5. The substrate is put into motion at a controlled speed relative to the printhead by motion of the printhead or the substrate, depending on the type of printer (step 1503).
6. The bias voltage of the printhead 100 is switched on (step 1504). This creates an electric field at the ejection tips 410 that moves the ink meniscus forward to cover the ejection tips 410 but which is not strong enough to eject the ink.
7. Ink is ejected selectively from the printhead 100 by application of a pulse voltage which, added to the bias voltage, creates an electric field of sufficient strength to create a force on the ink meniscus large enough to overcome the surface tension of the ink at the meniscus (step 1505). The voltage pulses are generated in accordance with the pixel data of the image to be printed, and the resultant pattern of ink ejection reproduces the image on the substrate.
8 When printing of the image is complete, the bias voltage is turned off (step 1506), the substrate motion is stopped (step 1507), and the vapour flow is turned off (step 1508).
9 END In this example scenario the flow of vapour is established prior to the motion of the substrate, and prior to the setting of the bias voltage. This ensures that the printhead environment is set to a state in which evaporation effects are reduced ready for when substrate motion and bias voltage are activated. Other sequences may also be used.

Description of Ink

Inks suitable for use in the electrostatic printheads described herein comprise one or more of the following components:
- a carrier liquid;
- a pigment that is predominantly insoluble in the carrier liquid;
- a dispersant that is soluble in the carrier liquid;
- a synergist; and
- a particle charging agent.

As used herein, a pigment is a material that changes the colour of the light it reflects as the result of selective colour absorption, including complete absorption (black), and no absorption (white). The pigment that is suitable for use in the invention is predominantly insoluble in the carrier liquid. Examples of pigments suitable for use in the present invention are: PB15:3 (cyan); PR57:1 (magenta); and PY12 (yellow).

The dispersant is usually a material such as a polymer, an oligomer or a surfactant, which is added to the ink composition in comparatively small quantities (less than the quantity of pigment) in order to improve the dispersion of the pigment particles in the carrier fluid. The dispersant is predominantly soluble in the carrier liquid. Preferably, it is an oligomer or a polymer. Examples of dispersants include Solsperse S17000 made by Lubrizol and Colorburst 2155.

The synergist is a chemical that promotes the interaction of the dispersant with the pigment. It is generally part pigment and part dispersant and as such has a high affinity for the pigment and the dispersant. An example of a synergist is Solsperse™ 22000 made by Lubrizol™.

The carrier liquid used in the ink compositions of the invention is preferably a liquid having high electrical resistivity. Preferably the electrical resistivity is at least $10^9$ ohm.cm. It is usually organic. Preferably, it is an aliphatic hydrocarbon, such as a $C_1$-$C_{20}$ alkane. More preferably, it is a branched $C_1$-$C_{20}$ alkane. Such liquids include Isopar™ G, hexane, cyclohexane and iso-decane.

The net evaporation rate (the rate of escape of molecules from the liquid surface less the rate of absorption of molecules back into the liquid surface) of the carrier liquid from a surface of the ink is dependent on the amount of vapour of the carrier liquid in the atmosphere above the ink surface. The net evaporation rate will be zero when the vapour is saturated. Below saturation, evaporation is reduced but not eliminated.

It is thought that the presence of a vapour of the ink carrier liquid reduces the evaporation of the carrier liquid, a necessary component in the cause of delayed print start, and the presence of a saturated vapour of the ink carrier liquid fully suppresses evaporation of the carrier liquid. As a result, the condition of the ink at the ejector tips 410 is maintained, and the viscosity of the ink at the ejector tips 410 does not increase undesirably. The ink can therefore be ejected readily when the pulse voltage is applied.

In an example, an ink comprising an Isopar™ G carrier liquid was used in the printhead. Isopar™ G is an isoparaffinic liquid manufactured by ExxonMobil™. As the gas flowing past the ejector tips 410 is pre-saturated with Isopar™ G, the evaporation of the carrier fluid from the ejector tips 410 is prevented.

The beneficial effect of the vapour was verified by substituting dry air (bypassing the vapour generator) through the maintenance channels 401 and cavity 402. This resulted in a substantial increase in the print start response time.

The presence of Isopar™ G vapour in the gas surrounding the ejector tips 410 clearly has a very significant benefit to the print start response, by controlling the local environmental conditions of the ejector tips 410 within the printhead 100.

The net evaporation rate of the carrier liquid from a surface of the ink is also dependent on the presence of other gas or vapour in the atmosphere at the ink surface. For example, a loading of one type of vapour in the atmosphere will reduce the capacity of the atmosphere to hold vapour of a second liquid and therefore reduce the net evaporation rate of the second liquid.

Experiments have shown that introduction of certain vapours significantly improves response time and in most cases eliminates a delay, i.e. printing starts up rapidly without delay. For example, introduction of a saturated Isopar™ C vapour atmosphere also eliminates a delay to print start when using an ink with an Isopar™ G carrier liquid.

Figure 15:
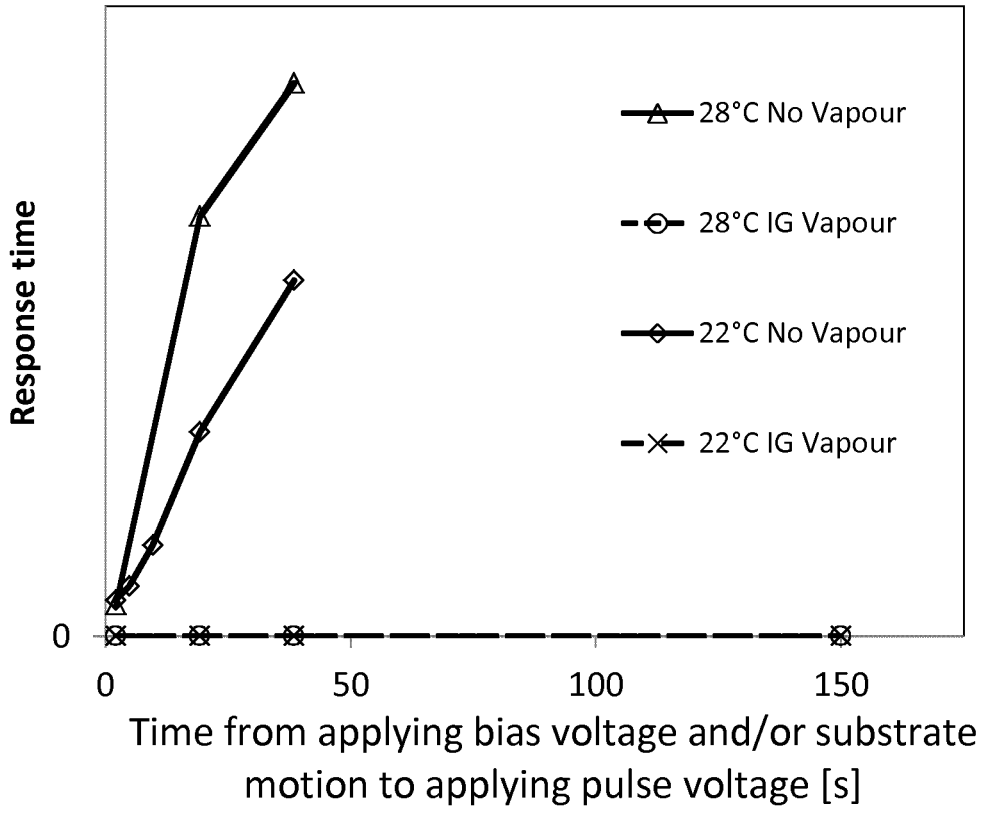
FIG. 15 is a graph which shows the effect of the application of a bias voltage in conjunction with motion of the substrate on the response time with increasing delay between the application of the bias voltage in conjunction with substrate motion and initiating printing, for two different ink temperatures, 22° C. and 28° C., when no IG vapour is supplied to the printhead cavity and when Isopar™ G vapour is supplied to the cavity.

The print start response time has been found to be dependent upon temperature. FIG. 15 shows the effect on print response time of increasing delay between the application of the bias voltage in conjunction with substrate motion, and the initiating of a printing operation by applying a pulse voltage. Data is shown for two different ink temperatures, 22° C. and 28° C., when no Isopar™ G vapour is supplied to the cavity 402 and when Isopar™ G vapour is supplied to the cavity 402.

Without the introduction of Isopar™ G vapour to the cavity 402, the response time is observed to increase as the delay time between the application of the bias voltage in combination with motion of the substrate and the application of the pulse voltage, as shown previously in FIG. 3. FIG. 15 shows that the response time is also increased at higher temperatures. This is considered to arise from the faster evaporation of carrier fluid at higher temperatures.

Under the same conditions but with Isopar™ G vapour introduced to the internal cavity 402 of the printhead 100, delay to the print start was found to be eliminated. This was found to be effective at both of the ink temperatures tested of 22° C. and 28° C.

It is well known that the saturation level of a liquid vapour in a gas depends on the temperature of the gas. At higher temperature a gas can hold more vapour. A saturated vapour that is cooled becomes super-saturated and will tend to precipitate or condense vapour until it reaches the saturation level for that cooler temperature. Hence, if the vapour generator 1102 is at a higher temperature than the printhead 100, the saturated vapour that leaves the vapour generator 1102 may become super-saturated at the printhead 100 and condensation on the internal surfaces of the printhead may result. If allowed to accumulate, this may interfere with the operation of the printhead. Hence it is desirable that the temperature of the printhead is not lower than the temperature of the vapour generator. However in practical implementations of the electrostatic inkjet printer where it is not possible or convenient to control the respective temperatures in this way, the adaptation of the vapour generating apparatus, as shown in FIG. 16, may be used to produce a sub-saturated vapour.

In the apparatus of FIG. 16, a second gas pathway links the gas supply, via a second flow controller 1118, to the output line of the sealed vessel 1102. This allows a flow of drying gas to be added to and mixed with the flow of saturated vapour leaving the sealed vessel 1102 to reduce the vapour concentration. The concentration can thus be set as a proportion of the saturation concentration by the relative flow settings of saturated vapour and drying gas and the total flow to the printhead is the sum of the two flow settings. The warmer sub-saturated vapour produced by the vapour generator and drying gas mixing system is then at the correct saturation level when it enters the cooler printhead cavity. This method can be used to eliminate any print start delay without causing condensation in a printhead operating at a temperature of approximately 5° C. below that of the vapour generator, using equal proportions of saturated Isopar™ G vapour and drying gas.

The drying gas may be a dry gas, i.e. a gas which has not intentionally had any form of vapour added to it or which has had any vapour removed from it. For example, the drying gas may be supplied from a compressed air source and, therefore, would be substantially dry, with any residual vapour likely to be water. Adding a dry gas to the vapour reduces the vapour concentration of the vapour.

The drying gas may be any gas with a vapour concentration lower than that of the vapour passed into the cavity 402 of the printhead 100.

The effect of adding the drying gas to the vapour is to reduce the vapour concentration of the vapour.

The second flow controller 1118 may be controllable, for example, by a printhead controlling computer (not shown), to deliver a flow rate of gas that is dependent on the operating conditions.

In the apparatus of FIG. 16, the flow of drying gas (for example, dry air or other dry gas) to be added to the flow of saturated vapour is provided by the same source that provides the flow of carrier gas into the vapour generator 1102, which may be a compressed gas source. In an alternative embodiment, the source of the flow of gas to be added to the flow of saturated vapour may be a distinct source. For example, separate gas sources, such as separate compressed gas sources, may be provided.

In electrostatic printhead systems it is usual to use a cleaning/rinse fluid for automated printhead cleaning as described above that is based on the same liquid as the ink carrier liquid. This is because a cleaning operation can place a small amount of rinse fluid into the ink and therefore it is beneficial to maintaining the correct composition of the ink for the rinse fluid to comprise the same carrier liquid.

The use of the ink carrier liquid as the main component in the rinse fluid provides an additional benefit for the generation of the vapour used to suppress evaporation. In this situation the same cleaning/rinse fluid can be used as the source of the vapour.

The integration of a cleaning/rinse fluid based vapour system therefore may not require additional fluid vessels or different consumable supplies. In other words, the cleaning/rinse fluid and the liquid vapour may be supplied to the printhead 100 from the same tank. For example, vapour could be collected from the headspace 1116 in the vessel 1102, shown in FIGS. 13 and 16, in the aforementioned manner, and liquid could be collected by the provision of a further outlet pipe (not shown) configured to collect cleaning/rinse fluid in the liquid form and transmit it to the fluid passages 401. Alternatively, the outlet pipe 1104 shown in FIGS. 13 and 16 could be moved such that its end is disposed within the cleaning/rinse fluid and such that it transmits cleaning/rinse fluid to the fluid passages 401.

In an example, Isopar™ G is used as the basis for the ink carrier liquid, the cleaning/rinse fluid and the vapour to suppress evaporation. However, this invention is not limited to the use of Isopar™ G vapour. Isopar™ C vapour has been shown to provide the same beneficial effect in reducing response time, and certain other vapours also have the same effect. These may include other Isopar™ grades, as produced by the ExxonMobil™ company, or other hydrocarbons.

Air is used as an example of the carrier gas for the vapour. However, this invention is not limited to the use of air, and certain other gases such as Nitrogen, may be used as the carrier gas.

The flow diagrams and processes herein should not be understood to prescribe a fixed order of performing the method steps depicted and described therein. Rather, the method steps may be performed in any order that is practicable. Although the present invention has been described in connection with specific exemplary embodiments, it should be understood that various changes, substitutions, and alterations apparent to those skilled in the art can be made to the disclosed embodiments without departing from the scope of the invention as set forth in the appended claims.

The invention claimed is:

1. A method of operating an electrostatic ink jet printhead, the electrostatic ink jet printhead comprising:

one or more electrostatic ejection tips, each electrostatic ejection tip being disposed at an end of an upstand with which an ink meniscus interacts, and from which, in use, ink is selectively ejected in response to a controllable electric field, the one or more electrostatic ejection tips defining one or more respective tip regions; and a printhead housing, the printhead housing defining a cavity within which the one or more electrostatic ejection tips are located, the printhead housing including an electrode plate having a slot configured to restrict a gas flow out of the printhead, and through which the one or more electrostatic ejection tips eject said ink, the method comprising the steps of, during a printing operation:

passing a vapour into the printhead and then into the cavity within the printhead to reduce evaporation of ink in the one or more respective tip regions of the one or more electrostatic ejection tips; and controlling a flow rate of the vapour into the cavity using a gas flow controller, wherein the flow of the vapour out of the printhead is restricted by the slot in the electrode plate of the printhead housing.

2. The method of claim 1, further comprising the step of, during a cleaning operation, passing a rinse fluid into the printhead and then into the cavity to clean the one or more electrostatic ejection tips.

3. The method of claim 2, wherein the vapour and the rinse fluid are supplied to the printhead and then into the cavity from a common tank.

4. The method of claim 3, wherein the vapour is generated within the common tank by bubbling a carrier gas through the rinse fluid.

5. The method of claim 2, wherein the printhead further comprises at least one passage extending through the printhead housing to the cavity and, wherein both of the vapour and the rinse fluid are passed to the cavity via the at least one passage.

6. The method of claim 1, wherein the method further comprises the step of, during a printing operation, adding a drying gas to the vapour prior to passing the vapour into the cavity.

7. The method of claim 6, wherein the method further comprises the step of, during a printing operation, controlling the flow rate of the drying gas added to the vapour using a second flow controller.

8. The method of claim 1, wherein the vapour comprises a liquid diffused or suspended in a carrier gas comprising one or more of: air, dried air and nitrogen.

9. The method of claim 6, wherein the vapour comprises a liquid diffused or suspended in a carrier gas, wherein the carrier gas and the drying gas are supplied from a common source.

10. The method of claim 8, wherein the liquid comprises a hydrocarbon and, wherein the hydrocarbon is preferably at least one of: an aliphatic hydrocarbon, a $C_1$-$C_{20}$ alkane, a branched $C_1$-$C_{20}$ alkane, hexane, cyclohexane, iso-alkane, iso-decane, iso-unedecane, iso-dodecane, or an isoparaffin.

11. The method of claim 2, wherein the rinse fluid comprises a hydrocarbon and, wherein the hydrocarbon is preferably at least one of: an aliphatic hydrocarbon, a $C_1$-$C_{20}$ alkane, a branched $C_1$-$C_{20}$ alkane, hexane, cyclohexane, iso-alkane, iso-decane, iso-unedecane, iso-dodecane, or an isoparaffin.

12. The method of claim 1, wherein the vapour is substantially saturated.

13. An electrostatic ink jet printhead assembly comprising:

at least one printhead, comprising:

one or more electrostatic ejection tips, each electrostatic ejection tip being disposed at an end of an upstand with which an ink meniscus interacts, and from which, in use, ink is selectively ejected in response to a controllable electric field, the one or more electrostatic ejection tips defining one or more respective tip regions; and a printhead housing, the printhead housing defining a cavity in which the one or more electrostatic ejection tips are located, the printhead housing including an electrode plate having a slot configured to restrict a gas flow out of the printhead, and through which the one or more electrostatic ejection tips eject said ink; and a tank configured to supply a vapour into the printhead and then into the cavity within the printhead during a printing operation so as to reduce evaporation of ink in the one or more respective tip regions of the one or more electrostatic ejection tips; and a gas flow controller configured to control a flow rate of the vapour into the cavity;

wherein the flow of the vapour out of the printhead is restricted by the slot in the electrode plate of the printhead housing.

14. The electrostatic ink jet printhead assembly of claim 13, further comprising at least one passage extending through the printhead housing to the cavity, wherein the at least one passage is configured to transmit the vapour from the tank to the cavity.

15. The electrostatic ink jet printhead assembly of claim 13, the electrostatic ink jet printhead assembly further comprising a gas supply configured to supply a carrier gas to the tank and a drying gas for adding to the vapour.

16. The electrostatic ink jet printhead assembly of claim 15, the electrostatic ink jet printhead assembly further comprising a second flow controller configured to control the flow rate of the drying gas added to the vapour.

17. The electrostatic ink jet printhead assembly of claim 13, wherein the electrostatic ink jet printhead assembly comprises a plurality of printheads, each printhead comprising a printhead housing defining a cavity, wherein one or more electrostatic ejection tips are located in each cavity and, wherein the tank is configured to supply the vapour into each printhead and then respectively to each cavity.

18. The electrostatic ink jet printhead assembly of claim 13, wherein the tank is further configured to supply a rinse fluid into the printhead and then to the cavity.

19. The method of claim 1, wherein the electrostatic ink jet printhead comprises a plurality of electrostatic ejection tips, said plurality of electrostatic ejection tips all being located in said cavity defined by the printhead housing.

20. The method of claim 1, further comprising generating the vapour external to the printhead.

21. The method of claim 1, wherein the flow of the vapour out of the printhead through the slot in the electrode plate is substantially parallel to the direction of the ink ejection.

* * * * *